US005829089A

United States Patent [19]

Steadman

[11] Patent Number: 5,829,089

[45] Date of Patent: Nov. 3, 1998

[54] CLEANING AND POLISHING MITT

[75] Inventor: Clay Steadman, Vernon, Canada

[73] Assignee: Steadman Venture's Corporation, Vernon, Canada

[21] Appl. No.: 855,784

[22] Filed: May 12, 1997

[30] Foreign Application Priority Data

Oct. 25, 1996 [CA] Canada ..... 2188837

[51] Int. Cl.[6] ..... A47K 7/02

[52] U.S. Cl. ..... 15/227; 2/158; 2/161.6

[58] Field of Search ..... 15/227; 2/158, 2/161.6

[56] References Cited

U.S. PATENT DOCUMENTS

| | | | |
|---|---|---|---|
| 235,268 | 12/1880 | Mayne | 15/227 |
| 730,471 | 6/1903 | McConnell | 2/161.6 |
| 1,231,168 | 6/1917 | Jones . | |
| 1,680,592 | 8/1928 | Chiles | 2/158 |
| 1,990,030 | 2/1935 | Jaffe . | |
| 2,364,749 | 12/1944 | O'Connell . | |
| 2,380,633 | 7/1945 | Daiber . | |
| 2,445,987 | 7/1948 | Ashman . | |
| 2,569,067 | 9/1951 | Ivshin . | |
| 2,642,573 | 6/1953 | Huck . | |
| 2,643,388 | 6/1953 | Curtis . | |
| 2,756,448 | 7/1956 | Werbe | 15/227 |
| 2,840,823 | 7/1958 | Kita . | |
| 2,942,442 | 6/1960 | Michael-Iohs | 15/227 |
| 4,712,253 | 12/1987 | Chen . | |
| 4,916,757 | 4/1990 | Berlin et al. . | |
| 5,008,969 | 4/1991 | Jarrett | 15/227 |
| 5,441,355 | 8/1995 | Moore . | |

*Primary Examiner*—Terrence Till
*Attorney, Agent, or Firm*—Sixbey, Friedman, Leedom & Ferguson, P.C.

[57] ABSTRACT

There is provided a mitt for use in cleaning and polishing. The mitt comprises a first and second portion, oppositely facing, peripheral edges stitched together except for an opening for inserting a user's hand, a thumb receptacle extending from the first and second portions, a forefinger receptacle extending from the first and second portions and having an aperture at an end remote from the first and second portions, the aperture of a size to permit passage of the forefinger therethrough and a receptacle for the remaining fingers extending from the first and second portions. The mitt is constructed so as to be suitable for use on either hand.

9 Claims, 1 Drawing Sheet

CLEANING AND POLISHING MITT

FIELD OF THE INVENTION

This invention relates to a mitt for use in cleaning and polishing of furniture, appliances, automobiles, windows and the like.

BACKGROUND OF THE INVENTION

It is often desirable to have a fresh cleaning surface when cleaning or polishing furniture, appliances automobiles, windows and the like. However, it is not always possible or convenient to have a new cleaning rag or cloth on hand. Often too, the rag or cloth currently being used with one cleaning preparation cannot be used with another cleaning preparation because the combination may cause damage to the article being cleaned or polished. For example, a person working on a piece of furniture may require one cloth for applying the wax or finish and another for buffing. However, two cloths may not be readily available.

It is thus desirable to have one cloth which can do the first job required, while still providing a fresh cleaning surface for the second job required. However, a simple cloth will not meet these needs and it is therefore necessary to use another type of apparatus. For example, a two-sided mitt which is designed to be reversible would fulfil these needs if the opposing sides were each provided with cleaning surfaces. Attempts have been made in the prior art to design a reversible mitt for cleaning or similar work applications. Reference is made for example to U.S. Pat. No. 2,840,823 of Kita, which issued Jul. 1, 1958, U.S. Pat. No. 1,990,030 of Jaffe, which issued Feb. 5, 1935, and U.S. Pat. No. 2,364,749 of O'Connell, which issued Dec. 12, 1944.

However, the reversible mitts of the prior art often limit the manual dexterity of the user and thus do not provide a means for a user to actuate a spray button on an aerosol can, such as a can of polish, or some similar button-actuated cleaning preparation.

SUMMARY OF THE INVENTION

It is thus an object of the present invention to provide an improved cleaning and polishing mitt.

In one aspect of the invention, there is provided a mitt for use in cleaning and polishing. The mitt comprises a first and second portion, oppositely facing, peripheral edges stitched together except for an opening for inserting a user's hand, a thumb receptacle extending from the first and second portions, a forefinger receptacle extending from the first and second portions and having an aperture at an end remote from the first and second portions, the aperture of a size to permit passage of the forefinger therethrough and a receptacle for the remaining fingers extending from the first and second portions. The mitt is constructed so as to be suitable for use on either hand.

In another aspect of the invention, the mitt is sewn in a flat seam.

In another aspect of the invention, the mitt is constructed of a material suitable for cleaning and polishing of furniture, appliances, automobiles, windows and the like, such as terry cloth.

BRIEF DESCRIPTION OF THE DRAWINGS

These and other advantages of the invention will become apparent upon reading the following detailed description and upon referring to the drawings in which.

Figure 1:
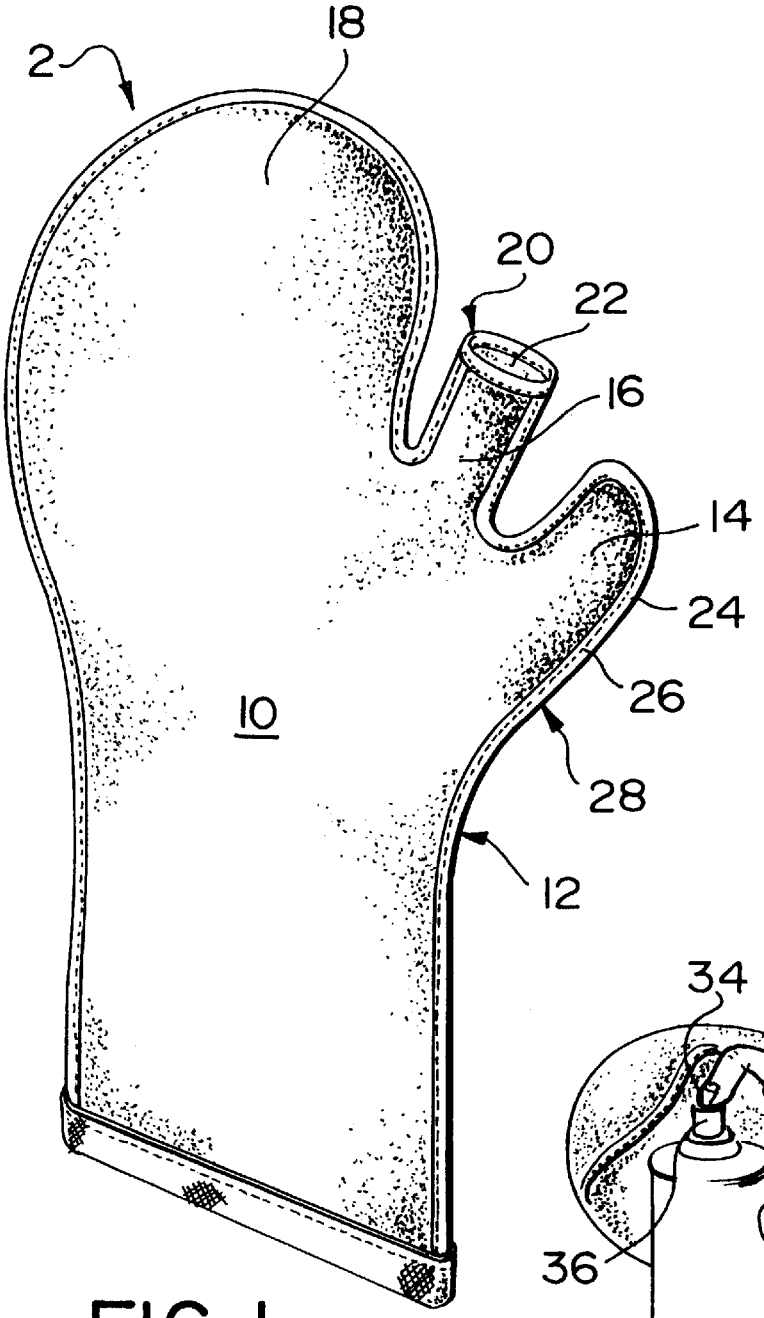
FIG. 1 is a perspective view of a cleaning and polishing mitt in accordance with the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings, FIG. 1 illustrates a mitt 2 for use in cleaning and polishing furniture, appliances, automobiles, windows and the like. The mitt 2 comprises a first portion 10 and a second portion 12 which are oppositely facing. Extending from the first 10 and second 12 portions, there are a thumb receptacle 14, a forefinger receptacle 16 and a finger receptacle 18.

Remote from first portion 10 and second portion 12, at end 20 of forefinger receptacle 16 there is provided an aperture 22 of a sufficient size to allow an end of a user's forefinger to pass therethrough. Alternatively, end 20 of forefinger receptacle 16 may simply be left open-ended.

To meet the object of the present invention, the mitt 2 is to be constructed in such a way that it may be reversible, that is so that it may be used equally on either hand. The first portion 10 and second portion 12, and thus, the receptacles extending from those portions 10 and 12, will preferably be sewn in a flat seam 24. There is an opening 25 in the seam 24 for inserting a user's hand for use of the mitt 2 and for added strength, there may be provided a cotton binding 26 about the peripheral edges 28 of the mitt 2.

Figure 2:
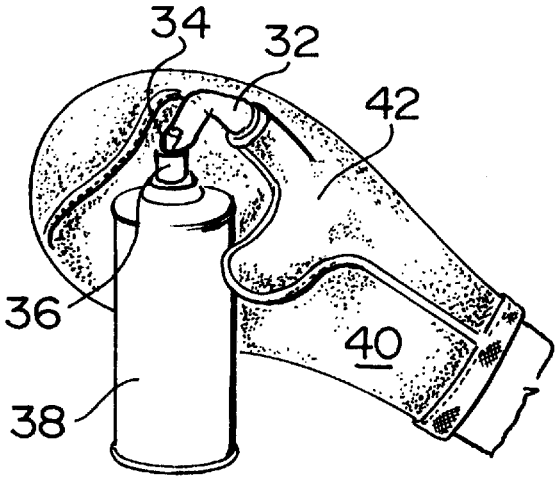
FIG. 2 is a perspective view of the mitt of FIG. 1 in place on a user's hand.

Referring to FIG. 2, the mitt 2 is shown in place on a user's hand. As shown, when the mitt 2 is worn on the user's right hand, the first portion 10 of the mitt 2 covers the user's palm and the second portion 12 covers the back of the user's hand. When worn on the left hand, the first portion 10 and the second portion 12 will be reversed relative to the palm and back of the hand.

The advantage of a having the large uniform surface area offered by a mitt is apparent in that it provides a greater working area for cleaning and polishing. With a glove in which all the fingers are separated, the cleaning or working surface area is limited to the palm portion and thus, of limited usefulness. However, the drawback of a mitt is that the dexterity offered by a glove is not present so that the user has difficulty operating spray bottles, opening cleaning jars and performing similar tasks which require a minimal amount of manual dexterity. With the mitt 2, regardless of on which hand, right or left, the mitt 2 is worn, the forefinger 32 is housed within the forefinger receptacle 16. The tip 34 of the forefinger 32 may thus extend through aperture 22 so that when the mitt 2 is being worn for cleaning or polishing, the user may actuate the spray button 36 on an aerosol can 38 of polish or a similar cleaning preparation. This permits a more efficient use of the mitt 2, in a manner similar to a glove, with respect to manual dexterity, while maintaining the useful working surface offered by a traditional mitt.

The mitt 2 should preferably be constructed of a durable material, suitable for use in cleaning and polishing. While a heavy terry cloth material may be best suited for this purpose, other material, such as chamois, will be similarly effective. In a preferred embodiment of the invention, the face 40 of the first portion 10 of mitt 2 and the face 42 of the second portion 12 of mitt 2 will be made of the same material such that either face may be used for the same cleaning or polishing application. However, it would also be within the scope of the present invention to have different material on the opposite faces 40 and 42 of the mitt 2. For example, face 40 may be of a terry cloth material better suited to washing, while face 42 may be made of chamois, better suited to drying or polishing. Thus, by switching the mitt 2 from the right hand to the left (or vice versa), an effective material surface is provided for the required task. Accordingly, the same mitt can be effectively used for two applications, or two steps within a cleaning process. For example, an object can be cleaned or waxed with one hand, using the appropriate products and the drying or buffing can be done with the other hand, using the appropriate products for that job. Thus, the need for two cloths is eliminated.

While the mitt 2 is contemplated to be made of a durable material which is reusable, the mitt 2 may also be made to be disposable after a single use.

Thus, it is apparent that there has been provided in accordance with the invention a mitt for use in cleaning and polishing of furniture, appliances, automobiles, windows and the like that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows:

1. A mitt for use in cleaning and polishing, the mitt comprising:

a first portion and a second portion oppositely facing;

peripheral edges stitched except for an opening for inserting a user's hand;

a thumb receptacle extending from said first and second portions;

a forefinger receptacle extending from said first and second portions and having an aperture at an end remote from said first and second portions, said aperture of a size to permit passage of an end of a forefinger therethrough; and a receptacle for the remaining fingers extending from said first and second portions, said mitt constructed so as to be suitable for use on either hand.

2. The mitt according to claim 1 wherein said mitt is sewn in a flat seam.

3. The mitt according to claim 1 further comprising cotton bindings about said peripheral edges of said mitt.

4. The mitt according to claim 1 having a material suitable for cleaning and polishing of furniture, appliances, automobiles, windows on said first and second portions.

5. The mitt according to claim 4 wherein said material is terry cloth.

6. The mitt according to claim 4 wherein said material is chamois.

7. The mitt according to claim 4 wherein the material on said first portion is different from the material on said second portion.

8. The mitt according to claim 1 wherein said mitt is disposable.

9. A mitt for use in cleaning and polishing, the mitt comprising:

a first portion and a second portion oppositely facing;

peripheral edges stitched except for an opening for inserting a user's hand;

a thumb receptacle extending from said first and second portions;

a forefinger receptacle extending from said first and second portions and having an aperture at an end remote from said first and second portions, said aperture of a size to permit passage of the forefinger therethrough; and a receptacle for the remaining fingers extending from said first and second portions, said mitt constructed out of terry cloth and sewn in a flat seam so as to be suitable for use on either hand, and having cotton bindings about peripheral edges of the mitt.

* * * * *